United States Patent [19]

de Vrijer

[11] Patent Number: 4,806,816

[45] Date of Patent: Feb. 21, 1989

[54] HIGH-PRESSURE DISCHARGE LAMP

[75] Inventor: Bertus de Vrijer, Eindhoven, Netherlands

[73] Assignee: U.S. Philips Corporation, New York, N.Y.

[21] Appl. No.: 109,801

[22] Filed: Oct. 16, 1987

[30] Foreign Application Priority Data

Oct. 20, 1986 [NL] Netherlands ..... 8602625

[51] Int. Cl.[4] ..... H01J 61/36

[52] U.S. Cl. ..... 313/331; 313/332; 313/623; 313/634

[58] Field of Search ..... 313/331, 332, 623, 634

[56] References Cited

U.S. PATENT DOCUMENTS

| | | | |
|---|---|---|---|
| 3,582,704 | 6/1971 | Fridrich | 313/332 X |
| 4,136,298 | 1/1979 | Hansler | 313/623 |
| 4,254,356 | 3/1981 | Karikas | 313/332 X |
| 4,396,857 | 8/1983 | Danko | 313/634 |

*Primary Examiner*—Leo H. Boudreau
*Assistant Examiner*—Mark R. Powell
*Attorney, Agent, or Firm*—Emmanuel J. Lobato

[57] ABSTRACT

The high-pressure discharge lamp has a discharge vessel (1) with neck portions (7) of reduced width. The electrode pins (9) have at their free ends an electrode head (10), whose largest diameter is larger than the diameter of the electrode pins (9). Due to the fact that the electrode head (10) must be able to pass through a duct in the neck portion (7) of reduced width when the lamp is assembled, the electrode (2) has lateral play, which may lead to a non-centered position of the electrode (2) in the discharge vessel (1). In the lamp according to the invention, this disadvantage is mitigated in that the electrode pin (9) in the neck portion (7) of reduced width has a transverse dimension which is larger than the diameter of the pin (9), for example due to the presence of a flattened part (11).

6 Claims, 1 Drawing Sheet

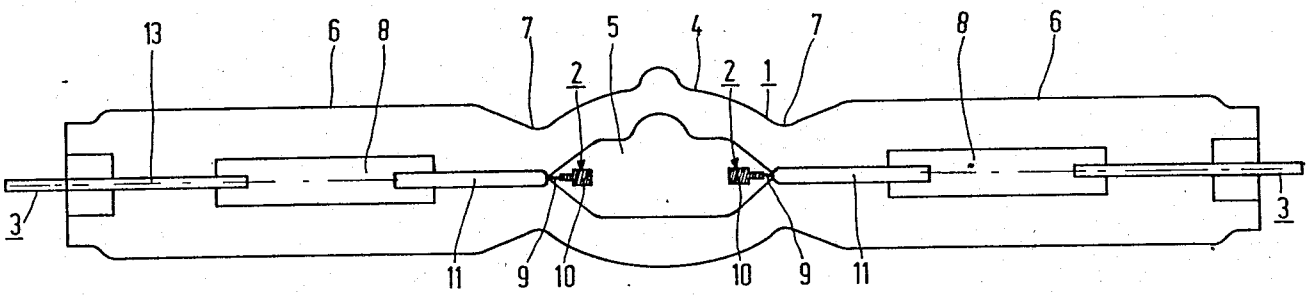
3
6
8
7
1
2
4
5
2
7
8
6
13
3
11
9
10
10
9
11

HIGH-PRESSURE DISCHARGE LAMP

BACKGROUND OF THE INVENTION

The invention relates to a high-pressure discharge lamp comprising:

- a quartz glass discharge vessel which is filled with an ionizable gas and in which electrodes are arranged opposite to each other;
- current-supply conductors which are connected to a respective electrode and which pass through the discharge vessel to the exterior;
- said discharge vessel having a first part which surrounds a discharge space, seals arranged opposite to each other and a respective neck portion of reduced width which adjoins the first part and a respective seal;
- said current supply conductors having in the respective seal a flat part adjoined by the glass of the seal in a vacuum-tight manner, and
- said electrodes comprising an electrode pin, which carries at its free end an electrode head, whose largest diameter is larger than the diameter of the electrode pin.

Such a lamp is known from U.S. Pat. No. 4,396,857.

In high-pressure discharge lamps, it may be of importance that the discharge space has a predetermined shape and size so that the lamps of one particular kind deviate only slightly from each other.

A discharge vessel is obtained from a tube, which may be cylindrical, and which is sealed at its end by causing the tube to collapse at its end or by pinching the tube at its end. For this purpose, the tube must softened at its ends by heating.

When the seals are provided, this also results in the tube being deformed between the seals. The deformation influences the shape and the size of the discharge space. It has been found that this deformation is not very reproducible. As a result, in lamps of a given kind, i.e. lamps having a small discharge space, this deformation has a great influence on the spreading of the shape and the size of the discharge space. This spreading becomes strongly manifest by the light-technical properties of lamps containing metal halide as a constituent of the ionizable gas and having a low power, for example 50 W or less.

The lamp according to the aforementioned U.S. Pat. No. 4,396,857 has neck portions of reduced width between the seals and the first part of the discharge vessel. The tube from which the discharge vessel is formed is provided with parts of reduced width before the seals are formed. They may be provided, for example, in the manufacturing step of the lamp in which the first part of the discharge vessel is formed. As a result, the shape and the size of the discharge space can be realized within very narrow limits When, at a later stage of manufacture of the lamp, the seals are formed the substantial deformation resulting from the formation of these seals is obtained at a certain distance from the first part of the discharge vessel. The neck portions of reduced width therefore constitute important means for bringing the shape and the size of the discharge space and hence the light-technical properties of lamps of a particular kind within narrow limits.

When the parts of reduced width are provided in the tube from which the lamp vessel is to be formed, in this tube two narrow ducts are formed, which, however, are sufficiently wide to allow the electrode pin with its wider electrode head to pass when the lamp is assembled.

For the properties of a high-pressure discharge lamp, the position of the electrodes in the lamp vessel, i.e. both the distance over which the electrodes project into the discharge space and their lateral position with respect to the lamp vessel, is of importance.

It has been found that the distance over which the electrodes project into the lamp vessel, is accurately reproducible, but that the lateral position of the electrodes is subject to variations from lamp to lamp.

The invention has for its object to provide a high-pressure discharge lamp of a construction which can readily be realized and which permits a small spreading in the position of the electrodes.

SUMMARY OF THE INVENTION

According to the invention, this object is achieved in a high-pressure discharge lamp of the kind described in the opening paragraph in that the electrode pins have within the neck portions of reduced width a transverse dimension which is larger than the diameter at their free end.

The electrodes and their current supply conductors constitute a slack assembly due to the fact that the current supply conductors have a flat part which can be adjoined in a vacuum-tight manner by the glass of the seals of the lamp vessel. Due to this slack assembly, it is difficult in the known lamp to position an electrode accurately in lateral directions in the lamp vessel to be formed and especially to keep it positioned when the relevant seal of the lamp vessel is formed. In the known lamp, it is true, the neck portions of reduced width have a narrow duct which limits the lateral displacement of the assembly of current supply conductor and electrode, but this limitation is insufficient. The head of the electrode that has to pass this duct is in fact much thicker than the electrode pin which becomes located in this duct.

In the lamp according to the invention, on the contrary, the electrode pin has within the neck portion of reduced width a transverse dimension which is larger than its diameter at its free end. As a result, the possibility of lateral displacement of the electrode pin and hence of the electrode is limited The locally larger transverse dimension of the electrode pin can be obtained in different ways.

The diameter of the part of the electrode pin located in the discharge space may be reduced by etching or grinding the pin.

A very attractive possibility consists in that the part of the electrode pin located in the neck portion is flattened and has consequently obtained a larger transverse dimension than the pin which is provided with this flattened part.

It is favorable if the flattened part is arranged parallel to the flat part of the associated current-supply conductor because, when a seal of the discharge vessel is formed, the current-supply conductor and hence the electrode are automatically centered in directions at right angles to this flat part. Just parallel to this flat part a high eccentricity is possible, which is suppressed more effectively by the flattened portion in the electrode pin when it is located parallel to the flat part of the current-supply conductor.

In a modification, the flattened part extends into the seal and the flattened part has a welding connection with the flat foil-shaped part of the current supply conductor. This has the advantage that this welding connection can be readily established by means of a laser.

The said possibilities have the advantage that for the assembly of current-supply conductor and electrode not a larger number of components is required than in the lamp according to the aforementioned U.S. Pat. No. 4,396,857.

The construction of the high-pressure discharge lamp according to the invention is very suitable both for use in lamps having pinch seals and in lamps having fused seals, which are formed by causing the glass to collapse This is of importance because consequently larger possibilities of manufacturing the lamp are available.

BRIEF DESCRIPTION OF THE INVENTION

An embodiment of the lamp according to the invention is shown in the drawing In the drawing:

The sole FIGURE is a side elevation of a lamp.

DETAILED DESCRIPTION OF THE INVENTION

In the FIGURE, the high-pressure discharge lamp has a quartz glass discharge vessel 1, which is filled with an ionizable gas and in which electrodes 2 are arranged opposite to each other. Current supply conductors 3, which are connected to a respective electrode 2, are passed from the discharge vessel 1 to the exterior. The discharge vessel 1 has a first part 4, which surrounds a discharge space 5, seals 6 arranged opposite to each other and a respective neck portion 7 of reduced width adjoining the first part 4 and a respective seal 6. The current supply conductors 3 have in the respective seal 6 a flat part 8, i.e. a foil of molybdenum, adjoined in a vacuum-tight manner by the glass of the seal 6. The electrodes 2 comprise an electrode pin 9, which carries at its free end an electrode head 10, whose largest diameter is larger than the diameter of the pin 9.

The electrode pins 9 have within the neck portions 7 of reduced width a transverse dimension which is larger than their diameter at their free end due to the presence of a flattened part 11. The flattened part 11 extends parallel to the flat portion 8 of the associated current-supply conductor 3. The flattened part 11 extends as far as said flat portion 8 and is connected thereto by means of a weld.

In an embodiment, the high-pressure discharge lamp according to the invention has the shape shown in the FIGURE. The discharge space 5 has a largest width of 2.7 mm. The distance between the electrodes 2 is 4.5 mm. The tungsten electrode pin 9 has a diameter of 200 μm. At its free end this pin has wound onto it in two layers a tungsten wire of 70 μm, on which the electrode head 10 has a largest diameter of 480 μm. The neck portion 7 of reduced width was initially provided with a duct having a diameter of 600 μm. The flattened part 11 of an electrode pin 9 has a transverse dimension of 450 μm. Its thickness had consequently decreased from 200 μm to 80 μm, a flattened part 11 thus still being thicker and more rigid than the molybdenum foil 8, which has a largest thickness of only 20 μm. Due to the flattened part 11, the lateral play in the neck portion 7 of reduced width has decreased from 400 μm (600≧200) to 150 μm (600–450). The maximum eccentricity of the electrodes is thus reduced from 200 μm to 75 μm. When the seals 6 are formed, the duct initially present in the neck portions 7 of reduced width is substantially closed without this leading to a perceptible spread from lamp to lamp in the shape and the size of the discharge space 5. The lamp consumes during operation at 85 V a power of 35 W and is suitable to be used as a car headlight lamp or a fog-lamp.

What is claimed is:

1. A high-pressure discharge lamp comprising:

a quartz discharge vessel which is filled with an ionizable gas and in which electrodes are arranged opposite to each other, current-supply conductors which are connected to a respective electrode and are passed from the discharge vessel to the exterior, said discharge vessel having a first part which surrounds a discharge space, seals arranged opposite to each other and a respective neck portion of reduced width adjoining the first part and a respective seal, said current-supply conductors having in the respective seal a flat portion adjoined by the glass of the seal a flat portion adjoined by the glass of the seal in a vacuum-tight manner, and said electrodes having an electrode pin, which carries at its free end an electrode head whose largest diameter is larger than the diameter of the electrode pin, characterized in that the electrode pins have within the neck portion of reduced width a transverse dimension which is larger than their diameter at their free end.

2. A high-pressure discharge lamp as claimed in claim 1, characterized in that the electrode pins have a flattened part within the neck portions of reduced width.

3. A high-pressure discharge lamp as claimed in claim 2, characterized in that the flattened part extends parallel to the flat portion of the associated current-supply conductor.

4. A high-pressure discharge lamp as claimed in claim 3, characterized in that the flattened part extends as far as the flat portion of the current-supply conductor.

5. A miniature high-pressure discharge lamp, comprising:

a discharge vessel comprising a hollow portion defining an internal cavity and tapering at opposite ends thereof into narrow neck portions, and a pair of end seals each closing a respective neck portion of said discharge vessel;

a pair of metal discharge electrodes each comprising an elongate body having a wide portion embedded within a respective narrow neck portion of said discharge vessel and a narrow portion extending into the internal cavity of said discharge vessel and terminating at a free end, and an electrode head disposed on the free end of said electrode within the cavity, and the respective electrode heads of said pair of discharge electrodes being spaced within the cavity; and a pair of current-supply conductors each embedded within a respective end seal and comprising a conductive foil of a different metal than said electrodes and having an end connected to the wide portion of a respective one of said electrodes, and a conductive lead connected to said foil and extending through said end seals and out of said discharge vessel for permitting external electrical connections thereto.

6. A miniature high-pressure discharge lamp according to claim 5, wherein said narrow portion of said electrodes has a transverse dimension of the order of 200 μm and said wide portion of said electrodes has a transverse dimension of the order of 600 μm.

* * * * *

UNITED STATES PATENT AND TRADEMARK OFFICE

CERTIFICATE OF CORRECTION

PATENT NO. : 4,806,816

DATED : February 21, 1989

INVENTOR(S) : Bertus De Vrijer

It is certified that error appears in the above-identified patent and that said Letters Patent is hereby corrected as shown below:

Col. 4, line 19, delete "a flat portion adjoined by the glass of the seal".

Signed and Sealed this

Seventeenth Day of April, 1990

*Attest:*

HARRY F. MANBECK, JR.

*Attesting Officer*

*Commissioner of Patents and Trademarks*